United States Patent [19]

Cuesta

[11] 4,307,699

[45] Dec. 29, 1981

[54] MULTIPLE MISSILE TYPE SLINGSHOT

[76] Inventor: Juan G. Cuesta, 8809 Grenore Dr., Dallas, Tex. 75218

[21] Appl. No.: 92,572

[22] Filed: Nov. 8, 1979

[51] Int. Cl.[3] ..... F41B 7/00

[52] U.S. Cl. ..... 124/22; 124/80

[58] Field of Search ..... 124/20 R, 20 A, 20 B, 124/41 R, 41 A, 41 B, 86, 87, 80, 22, 17; 273/419, 420, 423

[56] References Cited

U.S. PATENT DOCUMENTS 2,661,731 12/1953 Casey ..... 124/20 A 3,057,337 10/1962 Rock et al. ..... 124/20 A

FOREIGN PATENT DOCUMENTS 653458 5/1951 United Kingdom ..... 124/20 R

*Primary Examiner*—Richard C. Pinkham

*Assistant Examiner*—William R. Browne

*Attorney, Agent, or Firm*—Richard T. Seeger

[57] ABSTRACT

An elongated handle has a head at one end and a base at the other end. A plurality of inserts, one adapted for aiming and guiding each type of missile, such as an arrow or ball, is removably insertable into the head end. Elastic cords are removbly insertable into head end bores through narrow slots when the cords are in a stretched condition. The handle has a longitudinal chamber for missile storage.

11 Claims, 5 Drawing Figures

MULTIPLE MISSILE TYPE SLINGSHOT

BACKGROUND OF THE INVENTION

1. Field of the Invention

This invention is in the field of slingshot type devices and more particularly to the type capable of propelling a plurality of missile type.

2. Description of the Prior Art

Slingshot devices have been known for many years. Typically, the devices have a handle which has two spaced upstanding arms, the ends of which are attached to a resilient band which upon being manually stretched and released propels a pellet supported midway of the band. Other devices have attachments for converting the slingshot to propel arrows. The prior art is exemplified by devices shown in the following U.S. Pat. Nos. 2,613,659; 3,270,734; 1,960,645; 1,487,973; 271,568; 3,618,585; 2,625,925; 2,600,524; 3,407,798; 3,101,704; 2,691,973; 3,306,278; 3,524,439; 363,755.

However, due to the complexity, expense of manufacturing, and cumbersome nature of the devices for propelling multiple types of missiles in the prior art, they have not found wide usage.

SUMMARY OF THE INVENTION

An elongated handle provided with finger notches arranged longitudinally thereof has a laterally enlarged head at one end. A socket is formed in the head surface and extends substantially longitudinally into said handle. A planar shaped insert has a post depending from one side thereof that is removably insertable with a sliding fit into the socket. The insert surface is substantially co-extensive with the head surface.

The other side of the insert has upstanding aiming and missile guiding projections. The inserts are replaceable, each insert having projections suited to a particular missile type.

The head surface is provided with a pair of spaced bores which extend through the head. Each bore has a narrow slot between the bore and the head side for receiving a respective stretched elastic cord. Once the cord, in its stretched state, is passed through the slot, and the cord is returned to its unstretched state, the cord is retained laterally in the bore since the diameter of the unstretched cord is larger than the slot width.

Each cord is provided at each end with a button having a diameter larger than the bore diameter to retain one end of the cord longitudinally in its respective bore. The other ends of the cord are fitted through a respective hole in the end of a flexible missile supporting strap with the button at the other end being larger than the strap hole to thus attach the cord to the strap.

The insert is provided with a pair of openings which are registrable with the head surface openings. A narrow gap is between each opening and an insert edge, each being wide enough for receiving a respective stretched cord and prevent cord removal in an unstretched state. The gaps are non-aligned with the head slots to insure against cord removal from the head during operation.

A longitudinal chamber is provided in the other end of the handle for missile storage and a cap is provided for the open chamber end for ball or shot retention in the chamber.

It is therefore an object of this invention to provide a multiple missile type slingshot device that is relatively inexpensive to manufacture, simple in construction, and convenient and versatile in use.

Another object is to provide a device of the foregoing object that has a handle and replaceable inserts, each insert adapted for a particular missile type.

Another object of this invention is to provide a device of the foregoing object that has a forceful retention of the insert in the handle when a missile is being prepared for propelling and is being propelled.

A further object is to provide a device of the foregoing objects that has mountings for elastic cords that provide for relatively simple installation and replacement but are secure during operation.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
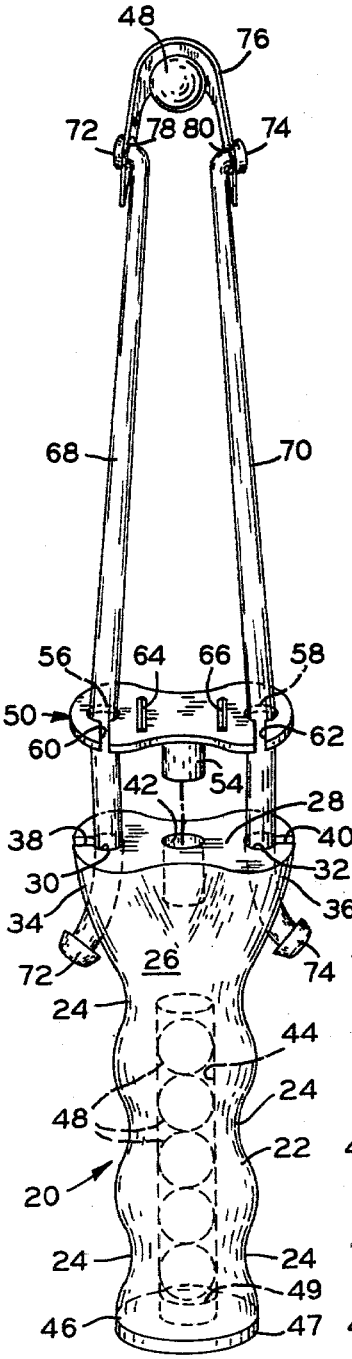
FIG. 1 is an exploded view in perspective of a preferred embodiment of my invention.

Referring to the drawing, a shooter 20 has an elongated handle 22 with finger notches 24 in longitudinal sequence on each side thereof. Handle 22 has a laterally enlarged head portion 26 having an hourglass shaped end surface 28. Head portion 26 has laterally spaced cylindrical bores 30, 32 extending from surface 28 to the head portion sides 34, 36 respectively. Narrow slot 38 is between bore 30 and side 34 and narrow slot 40 is between bore 32 and side 36. Socket 42 is formed centrally in surface 28 and extends longitudinally into head 36.

A longitudinal chamber 44 is formed in the other end of base end 46 of handle 22 and is dimensioned to store ball shaped missiles 48 which may be soft rubber balls or pellets. A cap 47 has a central plug 49 which has a frictional fit with the open end of chamber 44 to retain the balls in the chamber.

Insert 50 has planar surface 52 substantially co-extensive with surface 28 and has a post 54 depending therefrom which is received with a sliding frictional fit in socket 42 and when so received, the edge of surface 52 is then aligned flush with the edge of surface 28. If desired, socket 42 and post 54 may have similar polygonal crosssections so oriented that when post 54 is inserted into socket 42, the edges of surfaces 28 and 52 will be flush. Thus, insert 50 is removably attached to handle 22.

Laterally spaced round openings 56, 58 are formed in insert 50 and are registrable with bore openings 30, 32 in surface 28 when the edges of insert 50 and surfaces 28 and 52 are aligned. Narrow gaps 60, 62 are between openings 56, 58 respectively and the edge of insert 50. Gaps 60, 62 are not aligned with slots 38, 40 when surfaces 28, 52 are aligned to prevent inadvertent removal of cords 68, 70, later described. Elongated, laterally spaced, parallel ridges 64, 66 are formed on the upper side of insert 50 and are used for aiming a missile.

An elastic, cylindrical cord 68 has a button 72 attached to each of its ends as by vulcanizing or molding, and elastic cylindrical cord 70 has a button 74 similarly attached to its ends. Each of cords 68, 70 is stretched and then placed, respectively, in slots 38, 40, and then in gaps 60, 62. The width of slots 38, 40 and gaps 60, 62 are such that the stretched cords 68, 70 can pass through but passage of the cords in an unstretched state is prevented. Thus, cords 68, 70 are retained, respectively, in bores 30, 32, and in openings 56, 58, after passage through slots 38, 40, and gaps 60, 62, respectively. Further, since some slots 38, 40 are non-aligned, respectively, with gaps 60, 62, inadvertent removal of the cords from their respective bores and openings is prevented.

A flexible strap 76 has openings 78, 80 at the ends thereof through which buttons 72, 74, respectively, can be resiliently forced, but are dimensioned to prevent removal of the buttons through the openings in normal use. Alternatively, the ends of cords 68, 70 could be attached, as by vulcanizing or molding, to strap 76.

Figure 2:
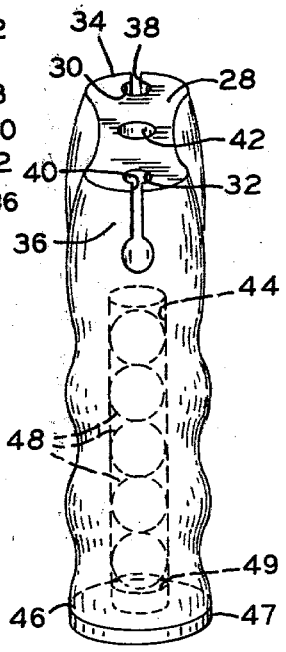
FIG. 2 is a second view in perspective of the handle of the embodiment of FIG. 1.

In operation of this device in FIG. 1 and FIG. 2, insert 50 is assembled to handle 22 after cords 68, 70 have been inserted in bores 38, 40, and openings 36, 58, as previously described, and post 54 is slidingly inserted with a frictional fit into socket 42. Cap 47 is removed allowing a ball 48 to be obtained from chamber 44. Ball 48 is placed centrally in strap 76, which is grasped with the fingers of one hand and with the other hand holding handle 22, the strap is pulled away from head 34, stretching the cords 68, 70 in a direction opposite to gaps 60, 62, thus urging insert 50 against surface 28, and insuring its retention in handle 22 during the period the missile is being prepared for propelling and during the period the missile is being propelled.

The top of shooter 20 is held at eye level. The target is aligned between ridges 64, 66 for aiming purposes. The ball is then released with a slight forward and downward movement of handle 22 to propel the ball towards the target 9. Due to the compact nature of the shooter, it may be easily stored and transported in a pocket of the user's clothing. The parts may be made of a molded plastic, reducing the cost of the shooter.

Figure 4:
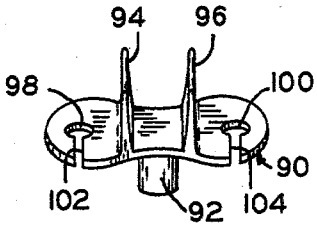
FIG. 4 is a partial, broken view of the insert FIG. 3.
Figure 3:
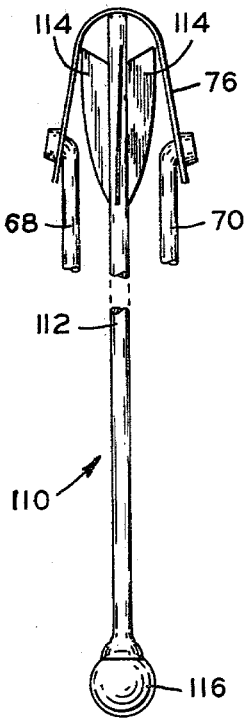
FIG. 3 is an enlarged view in perspective of a second aiming and guiding insert for use in the embodiment of FIG. 1.

Referring to FIGS. 3 and 4, an arrow shooting insert for handle 22 will be described. Insert 90 is generally planar in configuration and has a post 92 depending from the lower side thereof. Post 92 is removably insertable in socket 42 with a sliding frictional fit. A pair of spaced arrow guiding ears 94, 96 are upstanding from the upper surface of insert 90, and provides, as will become apparent, a guiding and aiming U-shaped cradle for an arrow shaft. Spaced, round openings 98, 100 are formed on either side, respectively, of ears 94, 96 and are connected, respectively, by gaps 102, 104 to the edges of insert 90, in the manner of and for the purposes of openings 56, 58, and gaps 60, 62 in insert 50.

When it is desired to use an arrow or harpoon with shooter 20, insert 50 is easily removed by lifting strap 76 from handle 22 in an upward direction when handle 22 is in an upright position, and stretching cords 68, 70 until they can pass respectively through gaps 60, 62. While cords 68, 70 are still in the stretched position, gaps 103, 104 of insert 90 receive cords 68, 70, respectively, and, after the cords are received by their respective openings in 98, 100, in insert 90, strap 76 may be returned and post 92 inserted in socket 42, preparing shooter 20 for use with an arrowtype missile.

An arrow 110 has shaft 112 provided with stabilizing vanes 114 at one end and a head 116 at the other end. Head 116 may be a soft rubber ball, as in FIG. 4, for games as shown or the more conventional piercing head for hunting or the like. An intermediate portion of shaft 112 is laid between ears 94, 96, and the vane end of arrow 110 is placed in strap 76 and manually grasped by the fingers of one hand, while handle 22 is grasped by the other hand. Strap 76 is then pulled away from handle 22, stretching cords 68, 70, with shaft 112 sliding between ears 94, 96, thus restraining lateral movement of shaft 112 and insuring accurate flight of arrow 110. Ears 94, 96 also serve as aiming guides with the target being viewed therebetween. A release of strap 76 sends the arrow unerringly towards the target due to the lateral guidance provided by ears 94, 96. Other inserts, adapted for other missile types, may be used with this invention to further increase its versatility.

Figure 5:
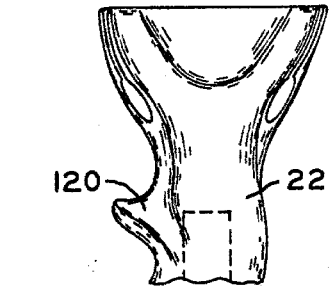
FIG. 5 is a partial enlarged view of a further embodiment.

Referring to FIG. 5, a laterally extending thumb support 120 is attached to a side of handle 22 and is upwardly inclined, thus providing a stablizing support when the user's thumb is placed on the upper surface thereof. A support 120 is placed on each side of handle 22 to accomodate both right and left-handed grasping of handle 22.

While there have been described above the principles of this invention, in connection with specific apparatus, it is to be clearly understood that this description is made only by way of example and not as a limitation to the scope of the invention.

What is claimed is:

1. A multiple missile type slingshot apparatus comprising:

an elongated handle having a head enlarged in a lateral direction at one end thereof; said head having an end surface in a plane substantially transverse to the lengthwise direction of said handle;

means being attached for tensional support to said handle head at said one end at transversely spaced points for holding a missile for resilient tensional displacement from said one end and for propelling a missile upon resilient return towards said one end;

a socket being formed in said head intermediate said spaced points and extending from said surface lengthwise into said handle;

an insert having a post depending from one side thereof; said post being insertable into and removable from said socket; said insert one side being in planar surface contact with said handle head end surface whereby said insert is stably and accurately supported and positioned relative said handle head end surface; said insert overlying said handle one end and being free of the tensional resilient forces in said means during displacement of a missile from said handle head end, whereby the entire tensional forces in said means are applied to said handle head end; and said insert having a structure used as an aiming sight and as a missile guiding support which projects from the side opposite to said insert one side.

2. The apparatus of claim 1 wherein said means is for urging said insert against said handle head surface during the resilient displacement and return.

3. The apparatus of claim 2 wherein said means comprises elastic cords, one cord being attached to each of said transversely spaced points on said handle head; said insert having openings through which said cords extend, whereby said cords overlie said insert and hold said insert firmly against said head during resilient displacement and return between a missile and said head.

4. The apparatus of claim 1 or 2 wherein said insert one side is substantially coextensive with the handle head surface of said one end of said handle.

5. The apparatus of claim 1 wherein said post has a sliding frictional fit with said socket.

6. The apparatus of claim 1 with finger notches being formed longitudinally along each side of said handle;

a longitudinal chamber being formed in the other end of said handle opposite to said one end for receiving and storing missiles; a cap being removably fittable into the end of said chamber for retaining missiles in said chamber.

7. The apparatus of claim 1 or 2 wherein said means comprises a pair of elongated elastic cylindrical cords, each of said cords having a button affixed to one end, thereof;

transversely spaced cylindrical bores being formed in said head and defining openings in said one end for receiving a respective elastic cord, said buttons having a diameter larger than the diameters of said bores;

a flexible strap; the other ends of said cords being attached, respectively, to opposite ends of said strap;

a slot being formed in said head between each bore and a head side;

said slots each having a width less than the diameter of an unstretched cord but having a width larger than the diameter of a stretched cord, whereby the cords are received by the slots into the bores in a stretched state and retained in the bores in an unstretched state.

8. The apparatus of claim 7 with transversely spaced openings being formed in said insert, said openings being registrable with said openings defined by said bores in said one end when said post is inserted into said socket;

a gap being between each insert opening and an insert side;

said gaps each having a width less than the diameter of an unstretched cord but having a width larger than the diameter of a stretched cord, whereby the cords are received by the gaps into the insert openings in a stretched state and retained in the insert openings in an unstretched state; said gaps being non-aligned with said slots.

9. The apparatus of claim 1 wherein said insert has an aiming sight comprising a pair of transversely spaced parallel aiming ridges on the side opposite to said one side.

10. The apparatus of claim 1 wherein said insert has a missile guiding support comprising a pair of transversely spaced upstanding ears on said side opposite to said one side.

11. The apparatus of claim 1 having a laterally extending, upwardly inclined thumb support attached to the side of said handle adjacent and below said head.

* * * * *